US005218798A

United States Patent [19]

Bentivegna et al.

[11] Patent Number: 5,218,798

[45] Date of Patent: Jun. 15, 1993

[54] EXTERIOR INSULATION FACING SYSTEM

[75] Inventors: Peter I. Bentivegna, Jeffersonville; Udo H. Maron, Willow Grove; Anthony J. Merlino, Philadelphia; Douglas C. Lindsay, Narberth, all of Pa.

[73] Assignee: BLM Group, Bala Cynwyd, Pa.

[21] Appl. No.: 767,851

[22] Filed: Sep. 30, 1991

[51] Int. Cl.[5] ..... E06B 7/14

[52] U.S. Cl. ..... 52/206; 52/209; 52/309.8; 52/309.16; 52/235; 52/795; 52/799; 52/52; 52/302.3

[58] Field of Search ..... 52/97, 198, 206, 209, 52/303, 309.11, 235, 795, 799, 169.5, 302

[56] References Cited

U.S. PATENT DOCUMENTS

| | | | |
|---|---|---|---|
| 1,676,094 | 7/1928 | Knox | |
| 2,057,654 | 10/1936 | Voigt | 72/16 |
| 2,264,961 | 12/1941 | Ward | 20/4 |
| 2,899,821 | 8/1959 | Nycander | 72/18 |
| 3,193,971 | 4/1961 | Galloway | 50/233 |
| 3,389,518 | 6/1964 | Horbach | 52/309 |
| 3,488,906 | 1/1970 | Brooks | 52/303 |
| 4,282,691 | 8/1981 | Risdon | 52/101 |
| 4,413,458 | 11/1983 | Ting | 52/481 |
| 4,642,958 | 2/1987 | Pewitt | 52/302 |
| 4,672,784 | 6/1987 | Pohlar | 52/235 |
| 4,685,263 | 8/1987 | Ting | 52/235 |
| 4,783,941 | 11/1988 | Loper et al. | 52/235 |
| 4,811,537 | 3/1989 | D'Epenoux | 52/385 |
| 4,819,405 | 4/1989 | Jackson | 52/810 |
| 4,840,004 | 6/1989 | Ting | 52/235 |
| 4,882,888 | 11/1989 | Moore | 52/309 |
| 4,899,508 | 2/1990 | Biebuyck | 52/235 |
| 4,924,647 | 5/1990 | Drucker | 52/235 |
| 5,016,415 | 5/1991 | Kellis | 52/522 |

OTHER PUBLICATIONS

"A Custom Engineered Panel System Utilizing Dryvit Exsulation or Outsulation Systems", Tech 21, p. 2.

"Prefabricated Outsulation Panel Systems", Dryvit Systems Inc, pp. 6 & 7.

"Buildings with a Past Have a Bright Future with Dryvit Outsulation", Dryvit Systems Inc, p. 2.

*Primary Examiner*—Carl D. Friedman

*Assistant Examiner*—Matthew E. Leno

*Attorney, Agent, or Firm*—Webb, Burden, Ziesenheim & Webb

[57] ABSTRACT

A laminated wall construction for building exteriors in which a facing outer layer provides the exterior surface and is attached to a corrugated layer such that the corrugations form vertical channels extending along the laminated wall construction. A trough is located at the lower end of the corrugated layer with weep holes formed in the trough whereby moisture which seeps through the facing outer layer flows down the corrugation layer of vertical channels into the trough and out of the weep holes.

20 Claims, 1 Drawing Sheet

EXTERIOR INSULATION FACING SYSTEM

The present invention relates generally to wall constructions for building exteriors and is particularly concerned with laminated wall constructions adapted to resist deterioration through water intrusion.

BACKGROUND AND SUMMARY OF THE INVENTION

It has long been conventional in the construction of exterior walls to utilize as a substrate a gypsum sheathing having treated paper adhered to the opposite surfaces thereof. The normal procedure has been to adhere an insulation layer to one of the paper faces of the gypsum substrate, and then an outer finish layer or coat is applied to the insulation layer to complete the assembly. Although this type of wall construction has generally proven to be satisfactory, water penetration may cause deterioration of the treated paper on the gypsum substrate, causing this to separate from the gypsum sheathing, hence adversely affecting wall integrity.

In an effort to improve wall integrity, a fiberglass mat has been adhered to the surface of the gypsum core in lieu of the conventional treated paper. However, it has been found that moisture penetration may still result in deterioration of the bond between the fiberglass and the gypsum core and may result in separation of the same from the gypsum core. The fiberglass has also been found to be subject to alkali attack as a result of the adhesive, resulting in deterioration and separation of the fiberglass from the gypsum core.

Another attempt at improving wall integrity is illustrated in U.S. Pat. No. 4,882,888. This patent discloses the coating of the fiberglass-faced gypsum with a water-based, water-resistant coating, such as water-based acrylic coating, prior to the application of any adhesive thereto, to form a barrier against excessive moisture penetration. This system may serve to limit water penetration but does not prevent deterioration once penetration does eventually occur.

The object of the present invention is to overcome the shortcomings of the aforementioned prior art. Another object of the instant invention is to eliminate deterioration of the substrate due to water penetration. An additional object of the present invention is to provide for the removal of water which does penetrate this system. Other objects, features and advantages of the invention shall become apparent as the description thereof proceeds in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
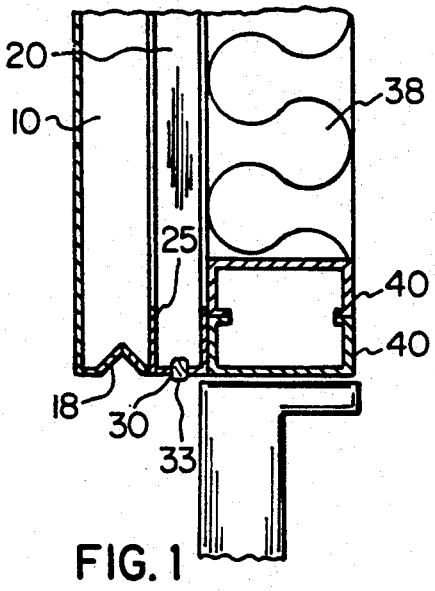
FIG. 1 is a cross-sectional side view of the laminated wall construction of the present invention showing the various layers and their relationship to one another, and illustrating the laminated wall construction of the present invention positioned adjacent a window unit.

FIGS. 1 and 3–6 illustrate the laminated wall construction which includes an outer layer 10 attached to corrugated layer 20 forming individual panel portions. The outer layer 10 may be formed (see FIG. 2) from a synthetic stucco 12 applied to a fiberglass mesh 14 over an expanded polystyrene board 16. The synthetic stucco may preferably be formed as an acrylic stucco. However, the outer layer 10 may be formed as any conventional, exterior facing.

Figure 4:
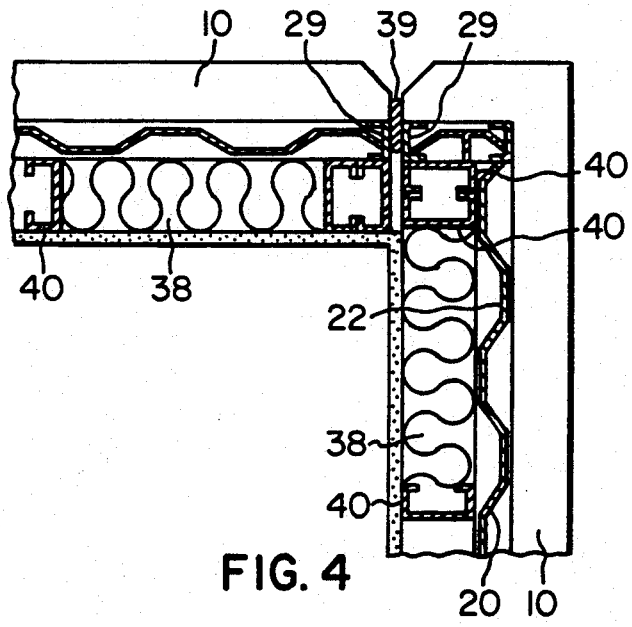
FIG. 4 is a cross-sectional top view of the laminated wall construction of the present invention formed in a corner portion of the building.

As best illustrated in FIG. 4, corrugated layer 20 is arranged relative to outer layer 10 such that the corrugations form vertical channels 22 extending along the wall construction. The corrugated layer 20 is preferably made from 1½" galvanized metal decking.

Figure 3:
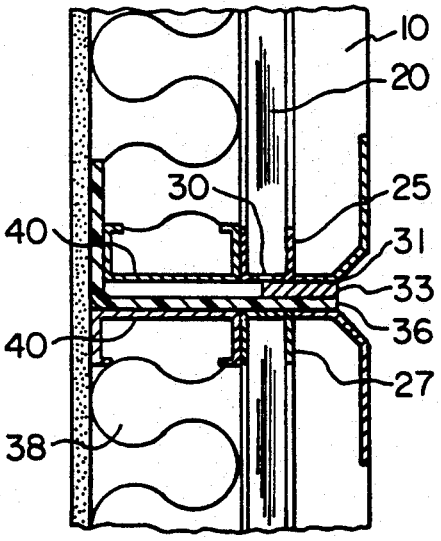
FIG. 3 is a cross-sectional side view of the laminated wall construction of the present invention illustrating two adjacent laminated wall construction portions.

As shown in FIGS. 1, 3 and 5–6, the channels 22 of the corrugated layer 20 are received in a trough 25 at a lower end of the corrugated layer 20. The trough 25 is illustrated as rectangular, but may be of any convenient shape to receive water from channels 22. The trough 25 extends generally the entire length of the corrugated layer 20 in each panel. FIG. 3 shows a closure cap 27 which is positioned at an upper end of the corrugated layer 20 to cap off channels 22. Closure members 29 (see FIG. 4) may be positioned at the sides of the corrugated layer 20.

Weep holes 30 are provided in trough 25. Trough 25 may be slanted toward weep holes 30 to allow for better water flow. A plurality of weep holes may be formed in trough 25 spaced at specific distances along the trough such as, for example, every four feet. Weep holes 30 are preferably ¼" in diameter.

Figure 2:
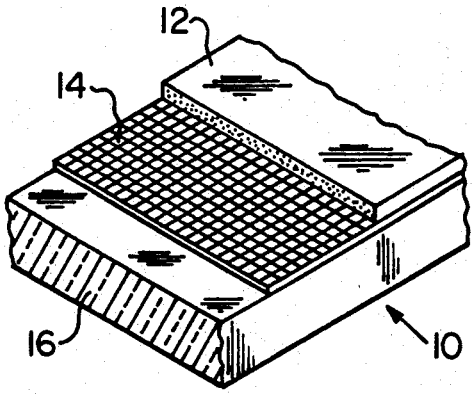
FIG. 2 is a schematic, fragmentary, perspective view, partially in cross-section, of the outer layer.

As shown in FIG. 1, the weep holes 30 may extend from the trough 25 to the exterior of the facing system or, as in FIGS. 3–6, may extend into one of a plurality of weeps 31. Weeps 31, if provided, are in joints formed either between adjacent laminated wall panels, as in FIG. 3, or joints formed between the laminated wall panel and the ground block, as in FIGS. 5–6. Weeps 31 may be formed as rectangular, plastic tubing. Backing rods 39 are also positioned in the joints providing additional support to the wall panels.

Weep holes 30 and weep 31 may receive a weep plug 33. The weep plug 33 may be, for example, an open cell gasket plug. The weep plug 33 serves a dual purpose of first acting as a wick to transport moisture from the interior to the exterior of the laminated wall construction, and second to seal the wall construction against unwanted intrusion from insects and the like.

An insulation layer 38 is positioned behind the corrugated layer 20. It has been found that foil-faced batt insulation works well for this purpose.

As best shown in FIG. 4, the corrugated layer 20 is attached to spaced metal studs 40 with the insulation layer 38 positioned between spaced metal studs. The studs are preferably 4" metal studs, and double stud arrangements are positioned at strategic locations for added strength, such as at corners or at window frames.

Figure 6:
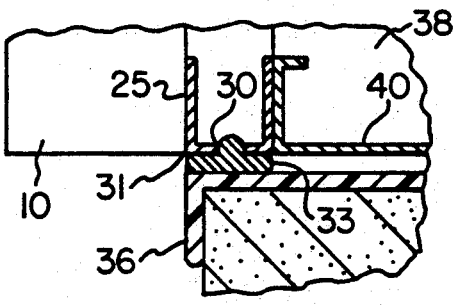
FIG. 6 is an enlarged cross-sectional view of the section marked in FIG. 5.
Figure 5:
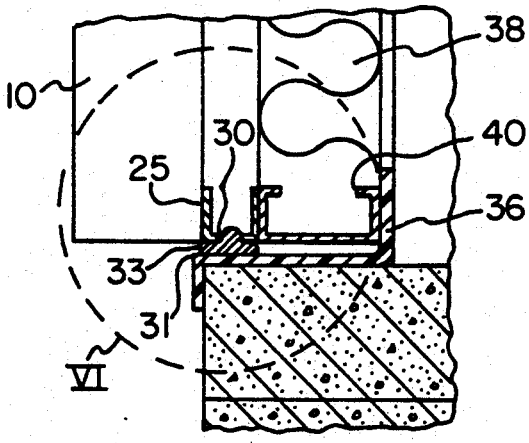
FIG. 5 is a cross-sectional side view of the laminated wall construction of the present invention illustrated near the ground block of the building.

As shown in FIGS. 3 and 6, flashing 36, preferably formed from rubber or metal, is positioned around the weep hole to prevent unwanted migration of moisture and to further seal this area.

This configuration, illustrated in the drawings, prevents deterioration of the substrate due to unwanted water penetration. In the event that the water does penetrate the outer layer, this water is collected in the vertical channels 22 of the corrugated layer 20 and flows into the trough 25 positioned at the lower end of the corrugated layer 20. The water is released from the bottom of the trough 25 through weep holes 30 which may be filled with weep plugs 33. The moisture then migrates directly to the outside of the building, or is collected in weeps 31 located in joints which release the water to the outside. The weep plug 33 is used as a wick to absorb and weep moisture to the outside of the laminated wall construction, as well as preventing insect intrusion into the interior of the laminated wall construction. Further vertical migration of the moisture is prevented by flashing 36 located at strategic horizontal positions. The outer layer 10 may be provided with a V-groove 18 to provide a finished edge at exposed end surfaces, such as illustrated in FIG. 1.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described except in so far as indicated by the scope of the following claims.

We claim:

1. A laminated wall construction for building exteriors comprising:

a plurality of panels, with each said panel including a facing outer layer providing the exterior surface, a corrugated layer attached to said facing outer layer such that vertical channels are formed by the corrugations, a trough receiving a lower end of said corrugated layer, at least one weep hole formed in said trough, whereby moisture which seeps through said facing outer layer flows down said corrugation layer vertical channels into said trough and out of said weep hole;

wherein each of said panel weep holes extend from said panel trough to a horizontal weep positioned underneath said panel, and said weep extending substantially horizontally to the exterior of the laminated wall construction;

wherein flashing is provided around said weep to prevent vertical migration of moisture;

wherein said flashing has a first portion which extends in a vertical direction in a position behind said panels relative to said building exterior, and a second portion which extends vertically adjacent said building exterior.

2. The laminated wall construction of claim 1 wherein an insulation layer is provided adjacent said corrugated layer between said corrugated layer and said first portion of said flashing.

3. The laminated wall construction of claim 1 wherein a plurality of weep holes are formed in said trough.

4. The laminated wall construction of claim 1 wherein a closure cap is provided at an upper end of said corrugated layer.

5. The laminated wall construction of claim 1 wherein each said panel corrugated layer comprises metal decking, and backing rods are provided between adjacent panels.

6. The laminated wall construction of claim 1 wherein said corrugated layer comprises 1½" galvanized metal decking.

7. The laminated wall construction of claim 1 wherein a weep hole plug is received in said weep hole and said weep and allows moisture to exit through said weep hole and said weep.

8. The laminated wall construction of claim 7 wherein said weep hole plug is an open cell gasket plug.

9. The laminated wall construction of claim 2 wherein the laminated wall construction is adapted to be attached to spaced metal studs and said insulation layer is located between said spaced metal studs.

10. The laminated wall construction of claim 7 wherein an insulation layer is provided adjacent said corrugated layer.

11. A laminated wall construction for building exteriors comprising:

a facing outer layer providing the exterior surface;

a corrugated layer attached to said facing outer layer such that vertical channels are formed by the corrugations;

a trough receiving a lower end of said corrugated layer;

at least one weep hole formed in the bottom of said trough, whereby moisture which seeps through said facing outer layer flows down said corrugation layer vertical channels into said trough and vertically out of said weep hole;

wherein each said weep hole is positioned vertically above a horizontal weep, with said weep extending to the exterior of the laminated wall construction;

wherein a weep hole plug is adapted to be received in said weep hole and said weep to allow moisture to exit through said weep hole and said weep;

wherein an insulation layer is provided adjacent said corrugated layer;

wherein said facing outer layer comprises a synthetic stucco applied to a fiberglass mesh over an expanded polystyrene board.

12. The laminated wall construction of claim 11 wherein flashing is provided around said weep hole to prevent vertical migration of moisture.

13. The laminated wall construction of claim 12 wherein a closure cap is provided at an upper end of said corrugated layer.

14. The laminated wall construction of claim 13 wherein the laminated wall construction is adapted to be attached to spaced metal studs and said insulation layer is located between said spaced metal studs.

15. The laminated wall construction of claim 7 wherein said weep hole is about ¼" in diameter.

16. The laminated wall construction of claim 11 wherein flashing is provided around said weep to prevent vertical migration of moisture.

17. The laminated wall construction of claim 10 wherein at least one surface of said outer layer is provided with a V-groove.

18. The laminated wall construction of claim 17 wherein backing rods are positioned between horizontally adjacent panels.

19. The laminated wall construction of claim 18 wherein said trough is slanted toward said weep holes.

20. A laminated wall construction for building exteriors comprising:

a plurality of panels, each said panel including a facing outer layer providing the exterior surface, a corrugated layer attached to said facing outer layer such that vertical channels are formed by said corrugations, a trough receiving a lower end of said corrugated layer, at least one weep hole formed in said trough;

each said panel week hole extends from said panel trough to a horizontal weep positioned vertically below said panel, said weep extending substantially horizontally to the exterior of said laminated wall construction;

whereby moisture which seeps through said facing outer layer flows down said corrugation layer vertical channels into said trough, vertically out of said weep holes into said weep, and horizontally through said weep to said exterior of said laminated wall construction.

* * * * *